United States Patent [19]

Takehara

[11] Patent Number: 4,688,455

[45] Date of Patent: Aug. 25, 1987

[54] CUTTING DEVICE FOR A BELT-LIKE OBJECT

[75] Inventor: Katsuomi Takehara, Mukou, Japan

[73] Assignee: Kabushiki Kaisha Takehara Kikai Kenkyusho, Kyoto, Japan

[21] Appl. No.: 825,928

[22] Filed: Feb. 4, 1986

[30] Foreign Application Priority Data

Feb. 22, 1985 [JP] Japan ..... 60-35090

[51] Int. Cl.[4] ..... B26D 7/14

[52] U.S. Cl. ..... 83/175; 83/313; 83/329; 83/424; 83/490

[58] Field of Search ..... 83/329, 330, 490, 313, 83/175, 424

[56] References Cited

U.S. PATENT DOCUMENTS

| | | | |
|---|---|---|---|
| Re. 30,598 | 5/1981 | Spencer | 83/329 X |
| 1,796,463 | 3/1931 | Kaltenbach et al. | 83/676 X |
| 2,692,645 | 10/1954 | Driesch | 83/490 X |
| 3,943,805 | 3/1976 | Lubitzsch | 83/329 X |
| 4,063,494 | 12/1977 | Hall | 83/329 X |
| 4,584,917 | 4/1986 | Blom | 83/329 X |

FOREIGN PATENT DOCUMENTS

| | | | |
|---|---|---|---|
| 848633 | 11/1939 | France | 83/490 |
| 56-49719 | 11/1981 | Japan . | |

*Primary Examiner*—James M. Meister
*Attorney, Agent, or Firm*—Wenderoth, Lind & Ponack

[57] ABSTRACT

A cutting device for a belt-like object is characterized by a pair of feed rollers and another pair of feed rollers which hold from both sides an object being supplied to be cut in succession. The rollers rotate at the same speed and are mounted in a horizontal direction respectively above and below the cutting position. The rotation of a main shaft driven by a motor is transmitted to a driving shaft of the pair of feed rollers placed above the cutting position through the main driving wheel of a one-way clutch. The rotation of the main shaft is also transmitted to a driving shaft of another pair of feed rollers placed below the cutting position through a subordinate driving wheel of said one-way clutch. An accelerating system and an electromagnetic clutch are provided between said main shaft and said driving shaft of the lower feed rollers, and said electromagnetic clutch is actuated in synchronism with the cutting cycle of a blade provided at a position close to said cutting position for cutting said object to be cut periodically in a crossing direction. The driving shaft of the lower feed rollers is accelerated when said blade has moved from the starting position to cutting to the finishing position and when the edge of the following object to be cut has been caught by said lower feed rollers.

6 Claims, 4 Drawing Figures

CUTTING DEVICE FOR A BELT-LIKE OBJECT

BACKGROUND OF THE INVENTION

1. Field of the Invention

The present invention is related to a cutting device for a belt-like object, being designed to be used when cutting a belt-like object such as a rolled paper or a long sheet of synthetic resin in desired lengths while feeding the object in succession.

2. Description of the Prior Art

The device for cutting a belt-like object being supplied in succession at a constant speed by desired length is commonly known in a form such as a cutter of a printing machine.

According to such conventional devices, it is generally required to provide a supporting member, which supports the cutting part of an object to be cut from behind, in the form of a frame. However, when cutting an object such as a tape being sticky on both sides as being supported it from behind, it easily happens that the tape itself sticks to the supporting member or that a sticky substance of the tape surface is removed and remains on the supporting member. Therefore, for cutting such an object such as this, it has been expected to develop a cutting device which can cut an object in a suspended state without providing a supporting member having such a function as described above.

SUMMARY OF THE INVENTION

The present invention is drawn to a device for cutting a belt-like object, being characterized by a pair of feed rollers and another pair of feed rollers which hold from both sides an object to be cut being supplied in succession and which rotate at the same speed and are mounted in a horizontal direction respectively above and below the cutting position. The rotation of a main shaft driven by a motor is transmitted to a driving shaft of the pair of feed rollers placed above the cutting position through a main driving wheel of a one-way clutch and the rotation of the main shaft is also transmitted to a driving shaft of another pair of feed rollers placed below the cutting position through a subordinate driving wheel of said one-way clutch. An accelerating system and an electromagnetic clutch are provided between said main shaft and said driving shaft of the lower feed rollers, and said electromagnetic clutch is actuated in synchronism with the cutting cycle of a blade provided at a position close to said cutting position for cutting said object to be cut periodically in a crossing direction. The driving shaft of the lower feed rollers is accelerated when said blade has moved from the starting position of cutting to the finishing position and when the edge of the following object to be cut has been caught by said lower feed rollers. As described above, the present invention is designed for holding a belt-like object to be cut both above and below the cutting position and for cutting the object in the middle. Therefore, it is possible to cut the object to be cut by a blade only and there is no need to support the object to be cut from behind.

BRIEF DESCRIPTION OF DRAWINGS

The drawings show the preferred embodiment of the present invention.

DETAILED DESCRIPTION OF THE PREFERRED EMBODIMENT

Now, the device according to the present invention is explained below with reference to the preferred embodiment of the cutting device for a belt-like object illustrated in FIGS. 1–4 of the attached drawings.

Figure 1:
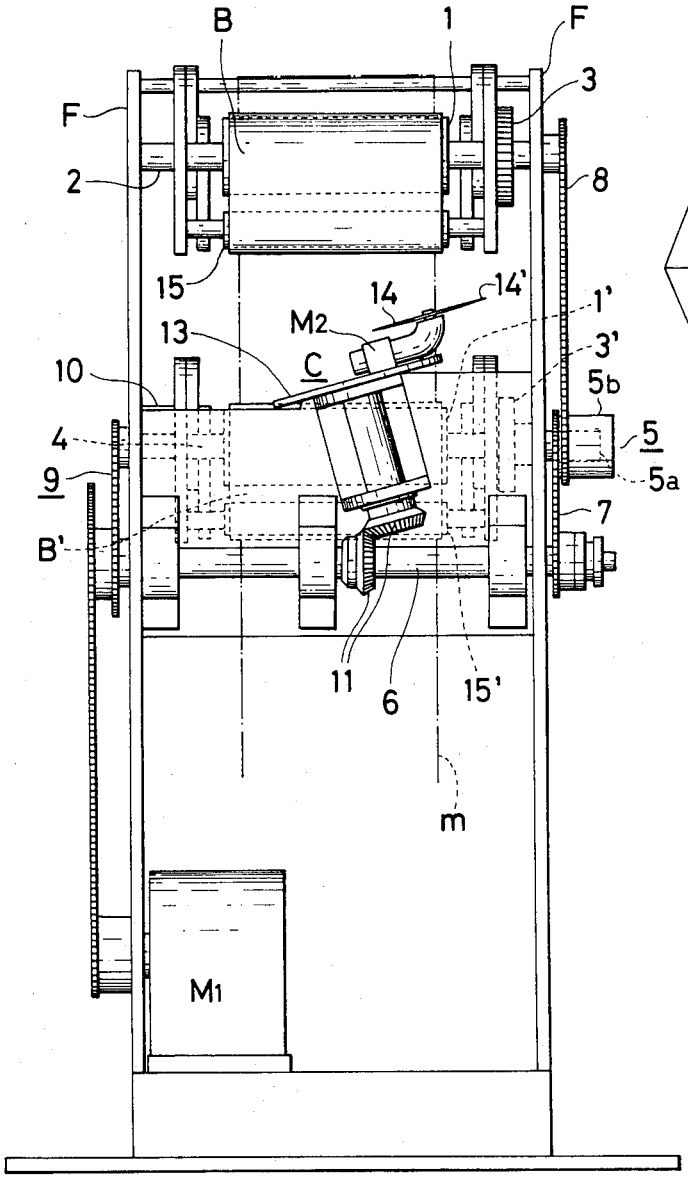
FIG. 1 is a side view, of the present invention.
Figure 4:
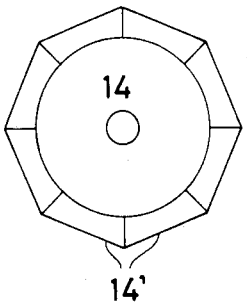
FIG. 4 is a plane view of the blade of the present invention.
Figure 2:
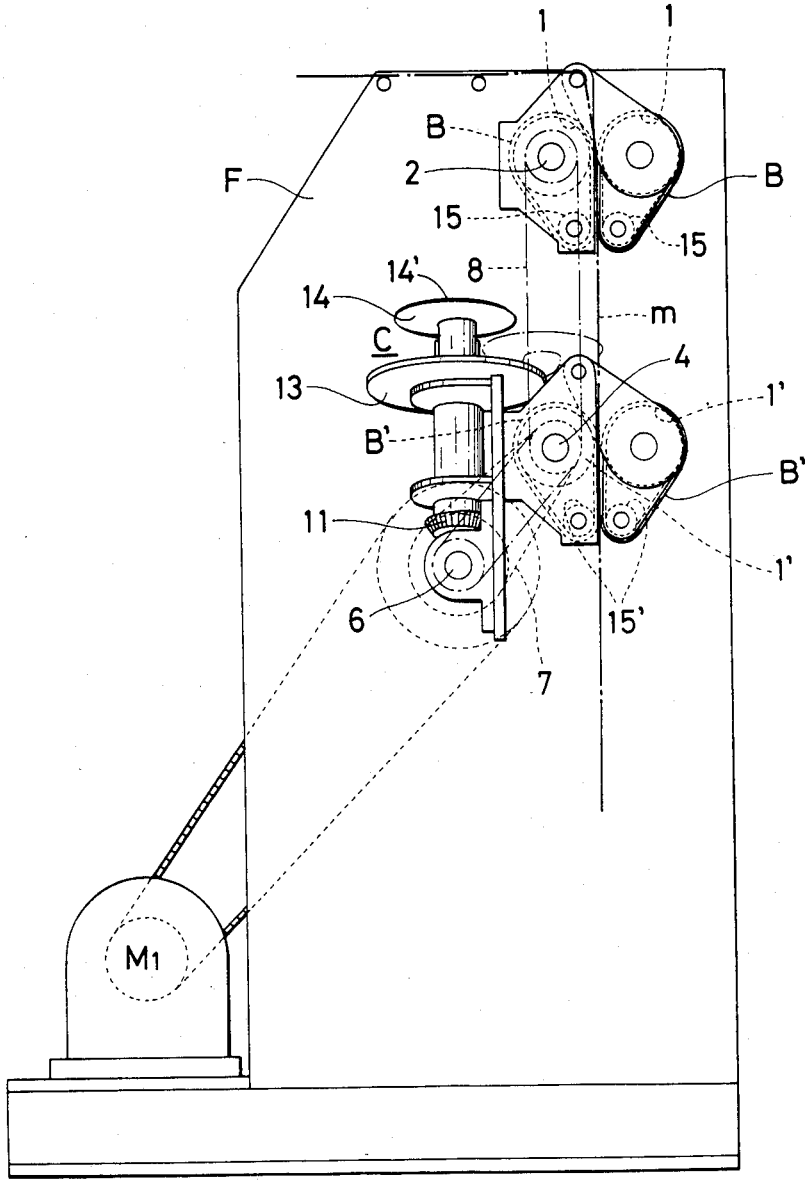
FIG. 2 is a front view of the present invention.
Figure 3:
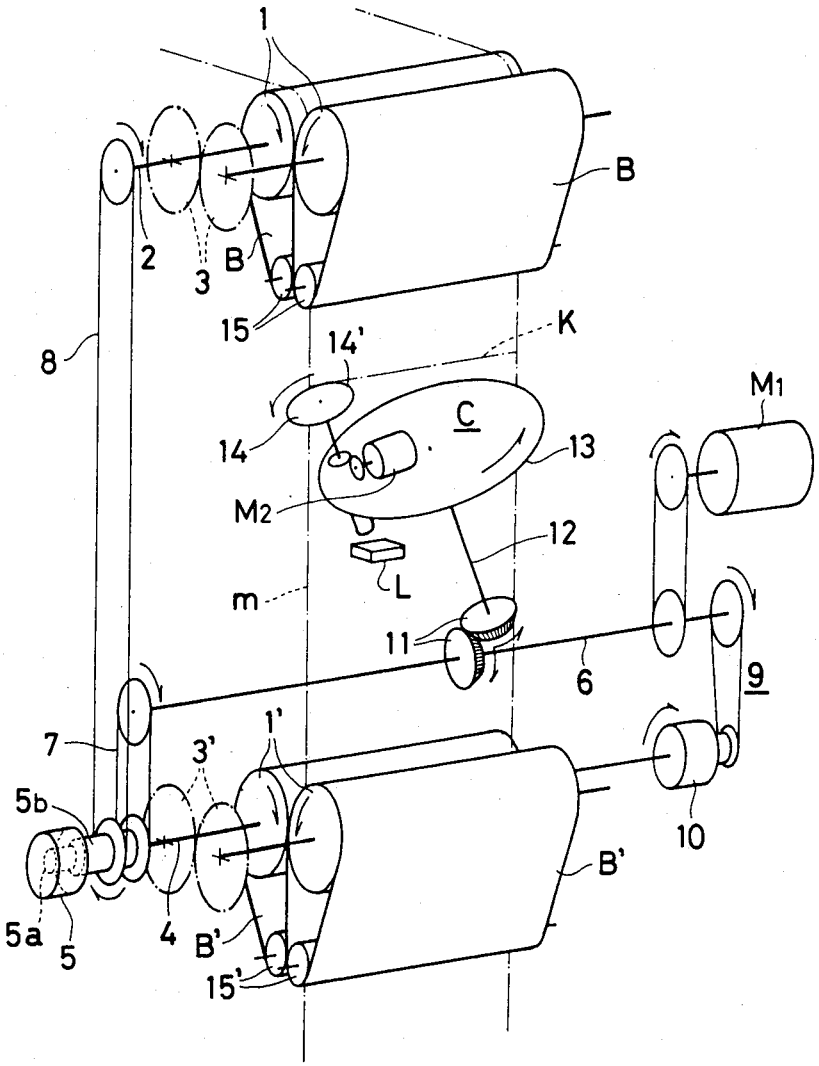
FIG. 3 is an oblique view illustrating, a driving mechanism of the present invention.

Numerals (1), (1') denote, as shown in FIG. 3, respective pairs of coacting feed rollers which rotate at the same speed, each roller pair holding from both sides a belt-like object to be cut which is supplied in succession. These feed rollers (1), (1') are mounted horizontally that the pairs of rollers are placed symmetrically at an upper part and at a lower part in the Frame (F), opposing to each other. Numeral (2) denotes a driving shaft which is provided coaxially with one of the feed rollers (1), (1) placed above the cutting position, that is to say, placed symmetrically at an upper part in the Frame (F) so as to hold an object (m) to be cut being supplied from above, and which rotates together with the shaft of the other feed roller (1) through a gear transmitting system (3). Numeral (4) denotes a driving shaft which is provided coaxially with one of the feed rollers (1') placed below the cutting position, that is to say, placed symmetrically at a lower part in the Frame (F), and which rotates together with the shaft of the other feed roller (1') through a gear transmitting system (3').

Numeral (5) denotes a one-way clutch fixed on one end of said lower driving shaft (4). As shown in FIG. 3, the one-way clutch (5) transmits the rotation of a main shaft (6) being driven by a motor (M1) to a main driving wheel **(5*a*) through a chain transmitting system (7) and turns said wheel. Then the main driving wheel (5*a*) turns said driving shaft (2) of the upper feed roller (1) through a chain transmitting system (8). On the other hand, a subordinate driving wheel (5*b*) is fixed to said driving shaft (4) coaxially with said main driving wheel (5*a*) and turns said lower feed roller (1') simultaneously with the upper feed roller (1). Numeral (9) denotes an accelerating system of a chain transmission type provided between the main shaft (6) and the other end of the driving shaft (4) of the lower feed roller (1'). In this case, the velocity ratio of the accelerating system (9)** is set as 1:2, but it can be changed to an optional one.

Numeral (10) denotes an electromagnetic clutch which is provided on said driving shaft (4) together with the accelerating system (9), and is ordinarily coupled with said accelerating system (9) in a released clutching state. Letter (C) denotes a cutter which is provided in the middle between the upper and lower feed rollers (1) and (1') and which cuts the object to be cut held by the upper and lower feed rollers (1) and (1') periodically in a crossing direction at a supposed cutting position (K) as shown in FIG. 3. The cutter (C) is driven by said main shaft (6) through a bevel gear transmitting system (11) and consists of an inclined shaft (12) being inclined at an appropriate angle in accordance with the speed of feeding of the object to be conveyed, a circular rotary plate (13) fixed to the top of said inclined shaft (12), and a blade (14) which is driven by a blade motor (M2) provided on the rotary plate (13) and which revolves around the inclined shaft (12) together with the rotary plate (13) and turns on its axis. While said blade (14) with an octagonal edge is moving along said supposed cutting position (K), it cuts the object (m) to be conveyed at about a right angle. Letter (L) denotes a limit switch provided so as to check the positions of the blade (14) immediately before and after the cutting operation.

By the signal from this limit switch (L), said electromagnetic clutch (10) which is coupled with the accelerating system (9) in a released clutching state is actuated just before the object (m) is cut to transmit the rotation of the main shaft (6) to said driving shaft (4) through the accelerating system (9), and said feed roller (1') placed below the cutting position is the turned at an increased speed. Thereby, the object (m) is cut by the blade (14) under a tension thus given. Immediately after the cutting operation finishes, said electromagnetic clutch (10) is released from coupling with the accelerating system (9), thereby allowing the revolution of the lower feed roller (1') to equal that of the upper feed roller (1) which has been turning at the same speed continuously. Then, the end of a following object (m) to be cut comes down through a pair of the upper feed rollers (1), (1) turning at a constant speed and is taken into a gap between a pair of the lower feed rollers (1'), (1'). Further, this example shows that the upper feed rollers (1), (1) and the lower feed rollers (1'), (1') have respectively subordinate rollers (15), (15) and (15'), (15') below them and having relatively smaller diameters, and that endless conveying belts (B), (B') are stretched over those feed rollers (1), (1) and (1'), (1') and subordinate rollers (15), (15) and (15'), (15'). However, in actual operation, a plural number of coiled springs (not shown in the drawing) may be stretched over each set of the feed roller and the subordinate roller endlessly so that their external surfaces form contacting surfaces which come into direct contact with the object (m) to be cut. Now, it has been stated above that the rotation of the feed rollers below the cutting position is accelerated so as to cut the object (m) to be cut under a tension. But, in actual operation of the present invention, it is possible to drop the speed of rotation of the upper feed rollers so as to give a tension to the object (m) to be cut which is held by the lower feed rollers.

The cutting device of the present invention thus constructed and thus operated has such effects that it is possible to hold the belt-like object to be cut above and below the cutting position and to cut it in a suspended state without supporting it from behind, and that the device is particularly suitable to cut an object that is sticky on its back.

I claim:

1. A cutting device for cutting a belt-like object at a cutting station, said device comprising:

a first pair of driven coacting feed rollers at one side of the cutting station for feeding the belt-like object toward the cutting station;

a second pair of driven coacting take-up rollers on the other side of the cutting station opposite from said first pair of coacting feed rollers, said second pair of coacting take-up rollers extending parallel to said first pair of feed rollers and positioned with respect to said first feed rollers for taking-up the belt-like object while it is being cut at the cutting station;

a cutter blade at said cutting station for cutting said belt-like object, and cutter means for moving said cutter blade across the width of said belt-like object periodically thereby cutting said belt-like object into strips each having a predetermined length;

drive transmission means operatively connecting said first pair of driven coacting feed rollers and said second pair of driven coacting take-up rollers for rotating said first pair of driven coacting feed rollers at the same rate as said second pair of driven coacting take-up rollers, and a one way clutch operatively connected to said drive transmission means for selectively engaging and disengaging said drive transmission means to operatively connect said first pair of driven coacting feed rollers with said second pair of driven coacting take-up rollers and to operatively disconnect said first pair of driven coacting feed rollers from said second pair of driven coacting take-up rollers respectively; and drive means operatively connected to said first and said second pairs of coacting rollers through said drive transmission means and said one-way clutch, said drive means driving said first and said second pairs of coacting rollers when said one-way clutch engages said drive transmission means to operatively connect said first pair of coacting feed rollers with said second pair of coacting take-up rollers; and an accelerating drive system having an electromagnetic clutch means and operatively connected to said second pair of driven coacting take-up rollers and to said drive means through said electromagnetic clutch means, said accelerating drive system causing said second pair of driven coacting take-up rollers to rotate at a greater speed than said first pair of driven coacting feed rollers when said electromagnetic clutch means is engaged to operatively connect said accelerating drive system with said drive means, when said one-way clutch disengages said drive transmission means to disconnect said first pair of driven coacting feed rollers from said second pair of driven coacting take-up rollers, while said belt-like object is being cut by said cutter blade at said cutting station.

2. A cutting device as claimed in claim 1, wherein said cutter means comprises a shaft operatively connected to said drive means to be rotated thereby and a rotary plate attached perpendicularly to said shaft and rotating therewith; and said cutter blade comprises a rotary blade rotatably mounted at a position along the periphery of said rotary plate and lying in a plane that is perpendicular to the belt-like object at said cutting station, and a blade motor means mounted to said rotary plate and operatively connected to said rotary blade for rotating said rotary blade, said shaft being skewed at a predetermined angle relative to the direction in which the belt-like object is being fed at said cutting station between said first and said second pair of coacting rollers such that as the belt-like object is fed past said cutting station by said first and second second pairs of coacting rollers driven by said drive means, said rotary plate rotated by said drive means moves said rotary cutter blade relative to the belt-like object to cut the belt-like object in a substantially straight path across the width of the belt-like object.

3. A cutting device as claimed in claim 1, wherein said cutter blade is polygonal.

4. A cutting device as claimed in claim 1, wherein said cutter blade is octagonal.

5. A cutting device as claimed in claim 2, wherein said cutter blade is polygonal.

6. A cutting device as claimed in claim 2, wherein said cutter blade is octagonal.

* * * * *